US010870899B2

(12) United States Patent
Kovacic et al.

(10) Patent No.: US 10,870,899 B2
(45) Date of Patent: Dec. 22, 2020

(54) FLUID ASSISTED PARTICLE INJECTOR

(71) Applicant: Berry Metal Company, Harmony, PA (US)

(72) Inventors: Thomas Kovacic, Bethel Park, PA (US); Gary Bugar, Renfrew, PA (US); Kenneth Geibel, Sarver, PA (US)

(73) Assignee: Berry Metal Company, Harmony, PA (US)

( * ) Notice: Subject to any disclaimer, the term of this patent is extended or adjusted under 35 U.S.C. 154(b) by 0 days.

(21) Appl. No.: 15/803,526

(22) Filed: Nov. 3, 2017

(65) Prior Publication Data

US 2018/0312934 A1 Nov. 1, 2018

Related U.S. Application Data

(60) Provisional application No. 62/416,803, filed on Nov. 3, 2016.

(51) Int. Cl.

| | |
|---|---|
| ***C21C 7/00*** | (2006.01) |
| ***F27D 3/18*** | (2006.01) |
| ***C21B 7/16*** | (2006.01) |

(52) U.S. Cl.

CPC ..... *C21C 7/0037* (2013.01); *C21B 7/163* (2013.01); *F27D 3/18* (2013.01); *F27D 2003/185* (2013.01)

(58) Field of Classification Search

CPC . C21C 7/0037; C21B 7/163; F27D 2003/185; F27D 3/18

USPC ..... 266/216, 265, 266, 267, 217

See application file for complete search history.

(56) References Cited

U.S. PATENT DOCUMENTS

| | | | | | |
|---|---|---|---|---|---|
| 3,321,139 | A * | 5/1967 | De Saint Martin | C21C 5/4606 | 239/132.3 |
| 5,333,840 | A * | 8/1994 | Skold | C21B 5/003 | 266/221 |
| 6,372,010 | B1 * | 4/2002 | Shver | C21C 5/5217 | 75/10.4 |
| 7,611,563 | B2 * | 11/2009 | Memoli | C21C 5/5217 | 266/221 |
| 8,080,200 | B2 * | 12/2011 | Kroemmer | C21B 5/003 | 266/225 |
| 8,919,670 | B2 * | 12/2014 | Shivaram | C21C 5/4606 | 239/403 |

(Continued)

FOREIGN PATENT DOCUMENTS

| | | | | |
|---|---|---|---|---|
| EP | 1170386 | | 1/2002 | |
| FR | 2432552 | * | 2/1980 | C21C 7/0037 |
| GB | 191113989 | | 2/1912 | |

*Primary Examiner* — Jessee R Roe

*Assistant Examiner* — Michael Aboagye

(74) *Attorney, Agent, or Firm* — Clark Hill PLC; Adam J. Fromm

(57) ABSTRACT

A fluid assisted particle injector for a metallurgical furnace, comprising: an injector tube having an entrance end, an exit end and a removable tip; a cover tube disposed over the injector tube; a fluid and particle injector port in line with the longitudinal center axis of the injector tube and a secondary fluid port for directing pressurized fluid over the outside of the injector tube and within the cover tube; the injector tube defining a tapered internal bore having a particle entrance end and a particle exit end, wherein the diameter of the particle exit end is smaller than the diameter of the particle entrance end.

7 Claims, 1 Drawing Sheet

(56) References Cited

U.S. PATENT DOCUMENTS

2007/0205543 A1* 9/2007 Lanyi ..... C21B 5/001
266/176

* cited by examiner

FLUID ASSISTED PARTICLE INJECTOR

This application claims the benefit of U.S. provisional patent application Ser. No. 62/416,803 filed Nov. 3, 2016, which is incorporated by reference herein for all purposes.

FIELD OF THE DISCLOSURE

The present disclosure generally relates to an improved particle injector useful in apparatus such as auxiliary burners and the like in metal melting, decarburization, refining and processing, for example, steel making in an electric arc furnace (EAF) or blast furnace.

BACKGROUND OF THE DISCLOSURE

Generally auxiliary burners are used to assist in the steel making process to add thermal energy by the combustion of fuel, the injection of oxidizing gas for melt refining, foamy slag production or post combustion of carbon monoxide, and the injection of particulates for slag and foamy slag production. In many instances, the oxidizing gas is introduced as a high velocity stream that may exceed sonic velocities.

Existing particle injectors have various deficiencies that detract from the efficiency and economy of the steelmaking process.

In order to overcome the disadvantages associated with typical particle injectors, it would be desirable to provide a particle injector that provides a simple effective alternative to more complex known injector designs and features reduced plugging, improved carbon/lime velocity; improved carbon/lime delivery to bath; ease of manufacturing and maintenance, and improved service life.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a fluid assisted particle injector for a metallurgical furnace, comprising: an injector tube having an entrance end, an exit end and a removable tip; a cover tube disposed over the injector tube; a fluid and particle injector port in line with the longitudinal center axis of the injector tube and a secondary fluid port for directing pressurized fluid over the outside of the injector tube and within the cover tube; the injector tube defining a tapered internal bore having a particle entrance end and a particle exit end, wherein the diameter of the particle exit end is smaller than the diameter of the particle entrance end.

In another aspect of a fluid assisted particle injector of the present disclosure, the removable tip of the injector tube defines a plurality of longitudinal grooves or channels on its outer surface which effectively act as nozzles for directing secondary air flow outside the removable tip for assisting with the injection of particles into the furnace.

In another aspect, the fluid assisted particle injector further comprises a wear liner disposed in the internal bore.

In another aspect of a fluid assisted particle injector of the present disclosure, the wear liner comprises a ceramic material, a replaceable ceramic material, other material or a coating.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single disclosure or inventive concept if more than one is in fact disclosed.

The following description is, therefore, not to be taken in a limited sense, and the scope of this disclosure is defined by the appended claims.

Figure 2:
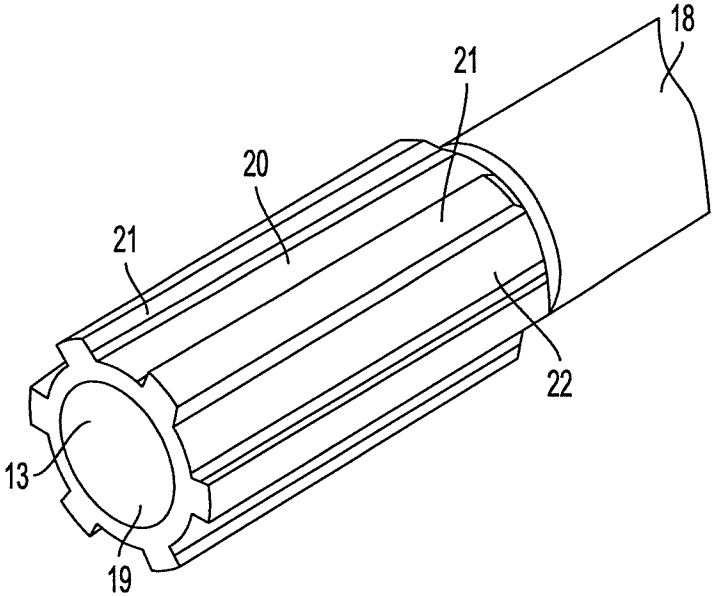
FIG. 2 shows an exterior top, perspective view of the tip of the fluid assisted particle injector of FIG. 1 with the cover tube removed.
Figure 1:
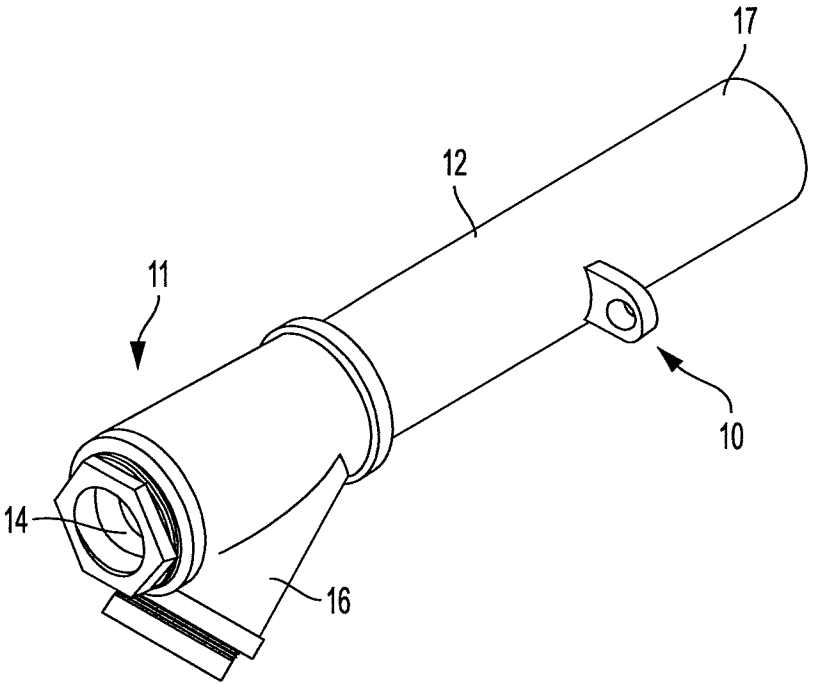
FIG. 1 shows an exterior top, perspective view of a preferred fluid assisted particle injector according to the present disclosure.

FIGS. 1-2 show a preferred fluid (air, gas, etc.) assisted particle (carbon/lime) injector 10 of the present disclosure that provides a simple effective alternative to more complex known injector designs and features reduced plugging; improved carbon/lime velocity; improved carbon/lime delivery to bath; ease of manufacturing and maintenance, and improved service life.

The preferred fluid assisted particle (carbon/lime) injector 10, such as for an EAF (Electric Arc Furnace), blast furnace or other type of metallurgical furnace, of the present disclosure, comprises: an injector tube 18 having an entrance end 11, an exit end 17 and a removable tip 20; a cover tube 12 disposed over the injector tube 18 and tip 20; a fluid/particle injector port 14 in line with the longitudinal center axis of the injector tube 18 and a secondary fluid port 16 for directing pressurized fluid over the outside of the injector tube 18 and within the cover tube 12; the injector tube 18 defining a tapered internal bore having a particle entrance end and a particle exit end, wherein the diameter of the particle exit end is smaller than the diameter of the particle entrance end.

In another aspect of a preferred fluid assisted particle injector 10 of the present disclosure, the removable tip 20 of the injector tube 18 defines a plurality of longitudinal grooves or channels 22 on its outer surface, such as between ribs 21, which effectively act as nozzles for directing secondary air flow outside the removable tip 20 for assisting with the injection of particles into the furnace.

In yet another aspect, a preferred fluid assisted particle injector 10 of the present disclosure further comprises a permanent or removable wear liner 19 disposed in the internal bore 13.

In another aspect of a preferred fluid assisted particle injector 10 of the present disclosure, the wear lining 19 comprises a ceramic material, a replaceable ceramic material, a replaceable other material or a coating.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

What is claimed is:

1. A fluid assisted particle injector for a metallurgical furnace, comprising:

a cover tube;

an injector tube defining an internal bore and having an entrance end, an exit end, a longitudinal center axis, an outside surface, and a removable tip having an outer surface, wherein the cover tube is disposed over the injector tube, and wherein the injector tube is substantially housed within the cover tube;

wherein the entrance end of the injector tube comprises both (i) a fluid and particle injector port in line with the longitudinal center axis of the injector tube for directing fluid and particles within the internal bore of the injector tube, and (ii) a secondary fluid port for directing a secondary fluid over the outside surface of the injector tube and within the cover tube;

wherein the internal bore of the injector tube is tapered at least within the removable tip and has a particle entrance end comprising a diameter at the entrance end of the injector tube and a particle exit end comprising a diameter at the exit end of the injector tube, wherein the diameter of the particle entrance end is larger than the diameter of the particle exit end;

wherein the removable tip of the injector tube defines a plurality of longitudinal grooves or channels on the outer surface of the removable tip, wherein the grooves or channels effectively act as nozzles for directing the secondary fluid outside the removable tip for assisting with the injection of particles directly into the furnace; and wherein the cover tube comprises a cover tube portion that defines an internal bore portion, wherein the cover tube portion is disposed over the removable tip and the removable tip is housed within the internal bore portion, and wherein the internal bore portion has a substantially uniform diameter.

2. The fluid assisted particle injector of claim 1, wherein the secondary fluid port is offset from the longitudinal center axis of the injector tube.

3. The fluid assisted particle injector of claim 2, wherein the secondary fluid is air.

4. The fluid assisted particle injector of claim 1, further comprising a wear liner disposed in the internal bore of the injector tube.

5. The fluid assisted particle injector of claim 4, wherein the wear liner comprises a ceramic material, a replaceable ceramic material, or a coating.

6. The fluid assisted particle injector of claim 1, wherein the particles are carbon or lime.

7. The fluid assisted particle injector of claim 1, wherein the fluid assisted particle injector is configured to deliver the particles into a molten metal bath at supersonic velocities.

* * * * *